United States Patent [19]

Laprad et al.

[11] 4,412,710

[45] Nov. 1, 1983

[54] GRAVITY-OPERATED LATCH FOR TILT-OUT CONSOLE FOR DISHWASHER

[75] Inventors: Paul J. Laprad, Lincoln Township, Berrien County; Gerald L. Wolanin, Baroda Township, Berrien County, both of Mich.

[73] Assignee: Whirlpool Corporation, Benton Harbor, Mich.

[21] Appl. No.: 272,385

[22] Filed: Jun. 10, 1981

[51] Int. Cl.[3] ..... A47B 96/00

[52] U.S. Cl. ..... 312/311; 312/313; 312/319; 312/292

[58] Field of Search ..... 312/311, 313, 319, 292

[56] References Cited

U.S. PATENT DOCUMENTS

| | | | |
|---|---|---|---|
| 587,412 | 8/1897 | Wesley . | |
| 1,335,415 | 3/1920 | Adams | 312/319 |
| 2,222,201 | 11/1940 | Ito | 312/313 |
| 2,723,746 | 11/1955 | Stevenson et al. . | |
| 2,759,227 | 8/1956 | Reid et al. . | |
| 3,049,115 | 8/1962 | Carnahan et al. | 312/319 |
| 3,205,510 | 9/1965 | Levine . | |
| 3,639,025 | 2/1972 | Donselman | 312/311 |
| 3,680,940 | 8/1972 | Johansson et al. | 312/313 |
| 3,738,727 | 6/1973 | Race et al. | 312/311 |
| 3,828,899 | 8/1974 | Scott . | |
| 3,954,172 | 5/1976 | Rinella . | |
| 4,306,757 | 12/1981 | Horvay et al. | 312/292 |

*Primary Examiner*—Victor N. Sakran

*Attorney, Agent, or Firm*—Wood, Dalton, Phillips, Mason & Rowe

[57] ABSTRACT

A dishwasher structure having a stop device responsive to swinging of the dishwasher door beyond a small preselected angle from a vertical closed position thereof for preventing pivoting of a control console by gravity from a retracted position within a recess in the door against biasing action of a biasing structure normally retaining the control console in retracted position within the door. The stop structure further effectively prevents the user from swinging the control console to the operative position when the door is swung from the vertical closed position beyond the preselected angle toward the open access position of the door. The stop structure is arranged to provide the latching function automatically as a result of the swinging movement of the door.

10 Claims, 5 Drawing Figures

FIG. 1
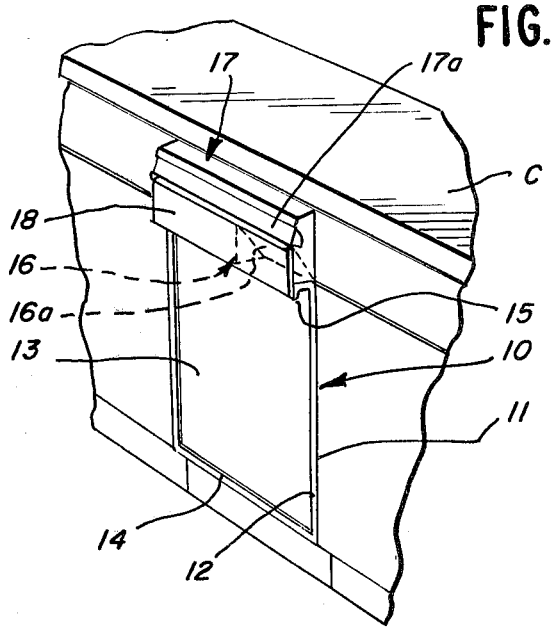
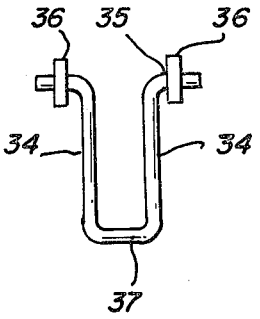
FIG. 4
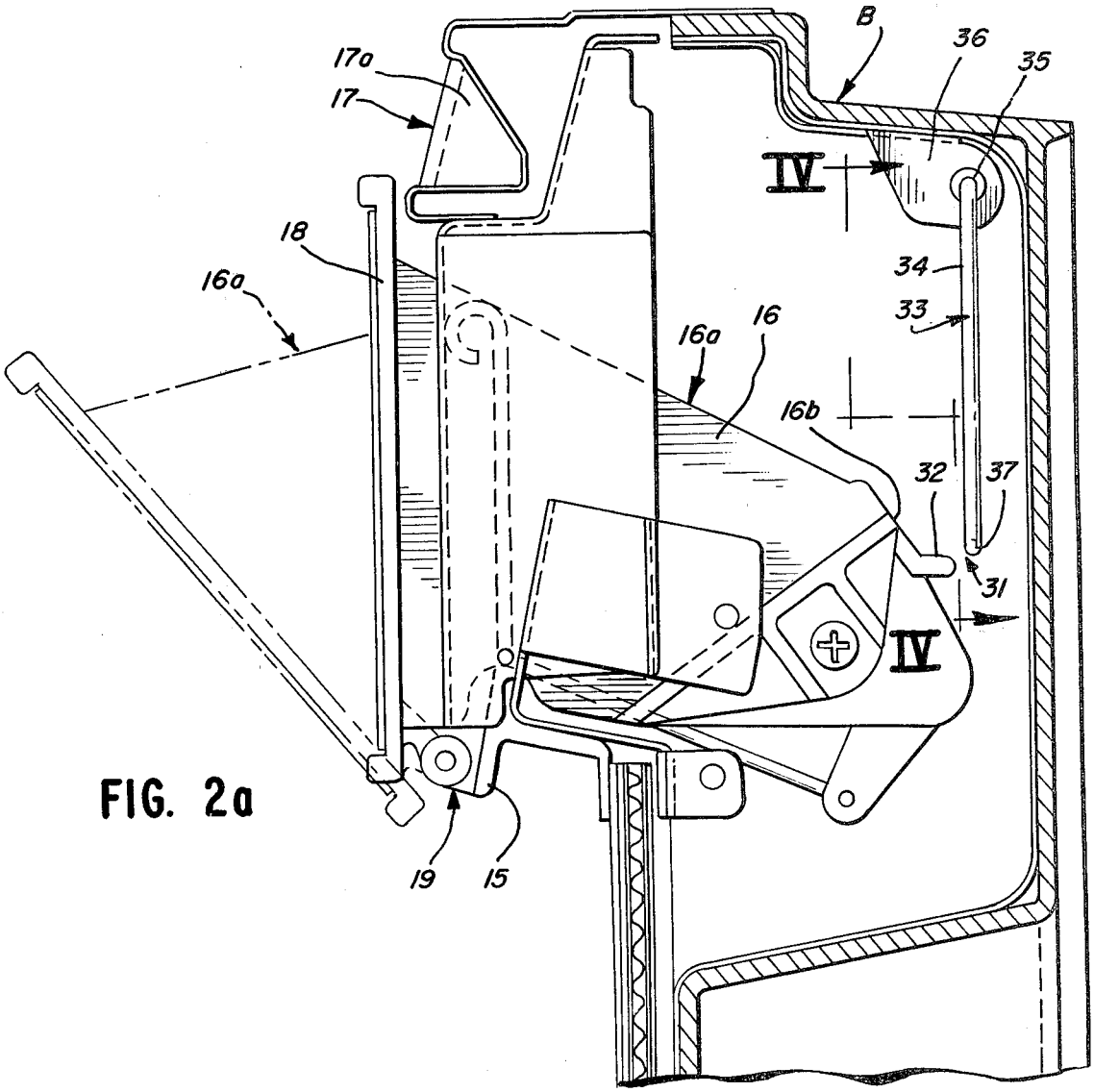
FIG. 2a

GRAVITY-OPERATED LATCH FOR TILT-OUT CONSOLE FOR DISHWASHER

BACKGROUND OF THE INVENTION

1. Field of the Invention

This invention relates to dishwashers and in particular to dishwashers having a control console swingably mounted to the access door thereof.

2. Description of the Background Art

In U.S. Pat. No. 3,680,940 of Rolf Johansson et al, a ventilating arrangement is shown for use in dishwashers wherein a shutter is provided for controlling access to the housing. The shutter is provided further with a ventilating arrangement having a valve normally retained in a position closing a passage through the shutter by an electromagnet controlled pawl.

John M. Wesley shows, in U.S. Pat. No. 587,412, a latch for mine car doors wherein the latch includes a portion engaging a chain which is released automatically when the mine car is swung to an inclined disposition.

Albert E. Stevenson et al disclose, in U.S. Pat. No. 2,723,746, a combined cigarette case and lighter wherein a selector selectively permits opening of the cigarette compartment or operation of the lighter in response to the attitude of the case relative to the vertical disposition.

James J. Reid et al, in U.S. Pat. No. 2,759,227, show a safety automatic door stop wherein a small door is mounted in a garage door adjacent a lower edge portion thereof. When the large door is brought into engagement with the garage floor a latch means having a downwardly projecting portion is urged upwardly by engagement with the garage floor to correspondingly urge a latch from locking engagement with the small door so that the door may be opened at that time. Upon raising of the main garage door, the latch is spring-biased into locking engagement with the small door so that it will not swing open in the opened arrangement of the large garage door.

In U.S. Pat. No. 3,205,510 of Morris Levine, a toilet seat cover is shown having a latch for selectively retaining a small cover mounted within the large cover of the toilet structure. The latch is gravity-biased against a spring-biasing means thereof to lock the small cover to the big cover when the big cover is swung upwardly from the toilet bowl.

Charles J. Scott shows, in U.S. No. 3,828,899, an orientation sensitive luggage latch which prevents opening of the luggage case when the top cover portion of the case is lowermost.

In U.S. No. 3,954,172, Anthony J. Rinella illustrates a bait box having two hingedly mounted doors. A weight-biased drum is provided within the box and includes a slot in a flange portion thereof which cooperates with projections on each of the doors to permit either of the doors to be opened only when that door is uppermost.

SUMMARY OF THE INVENTION

The present invention comprehends an improved dishwasher structure wherein a dishwasher having a dishwashing chamber is selectively closed by an access door. The door is pivotally mounted along a lower portion to the cabinet of the dishwasher to swing downwardly from an upright chamber-closing disposition to a lower, generally horizontal accessproviding disposition. The door carries at its distal edge portion a tilt-out control console which is normally biased to a recessed disposition within the door by light biasing spring means. The control console may be swung outwardly from the recessed position against the biasing spring means to expose manually operable program input switches for actuation by the user, thereby to establish the desired dishwashing cycle.

Upon release of the control console, the relatively light biasing spring means restores the console to the recessed disposition.

The invention comprehends the provision of stop means responsive to swinging of the main door beyond a small preselected angle from the vertical closed position thereof for preventing pivoting of the control console by gravity, downwardly from the retracted position against the biasing action of the biasing spring means. The stop means further prevents the user from swinging the control console to the operative position when the door is swung from the closed position while permitting free pivoting of the control console by the user to the operative position against the biasing action of the spring means when the door is less than the preselected angle from the vertical closed position thereof.

In the illustrated embodiment, the stop means includes a stop shoulder fixed to the control console and a latch movably carried by the door for engagement with the stop shoulder as a result of the swinging of the door beyond the preselected angle.

In the illustrated embodiment, the latch comprises a formed-wire U-shaped element and the stop means comprises a projecting tongue on a rear portion of the control console.

In the illustrated embodiment, the biasing means comprises a torsion spring and means for winding the torsion spring as a result of pivotal movement of the control member. The winding means is arranged to wind the spring an angular amount less than the angular amount of pivoting of the control console to effectively minimize the biasing force applied by the biasing means to the control console for facilitated setting of the controls by the user in the operative position.

The dishwasher structure of the present invention is extremely simple and economical of construction while yet providing an improved control of the swinging movement of the tilt-out control console relative to the main dishwasher door in the different closed and access-providing dispositions thereof.

BRIEF DESCRIPTION OF THE DRAWING

Other features and advantages of the invention will be apparent from the following description taken in connection with the accompanying drawing wherein:

FIG. 1 is a fragmentary perspective view of a kitchen cabinet installation having a dishwasher embodying the invention;

FIG. 2 is a fragmentary enlarged vertical section of the dishwasher structure illustrating in greater detail the control console means thereof;

FIG. 4 is a view of the latch element along lines IV—IV of FIG. 2*a*.

DESCRIPTION OF THE PREFERRED EMBODIMENT

Figure 2B:
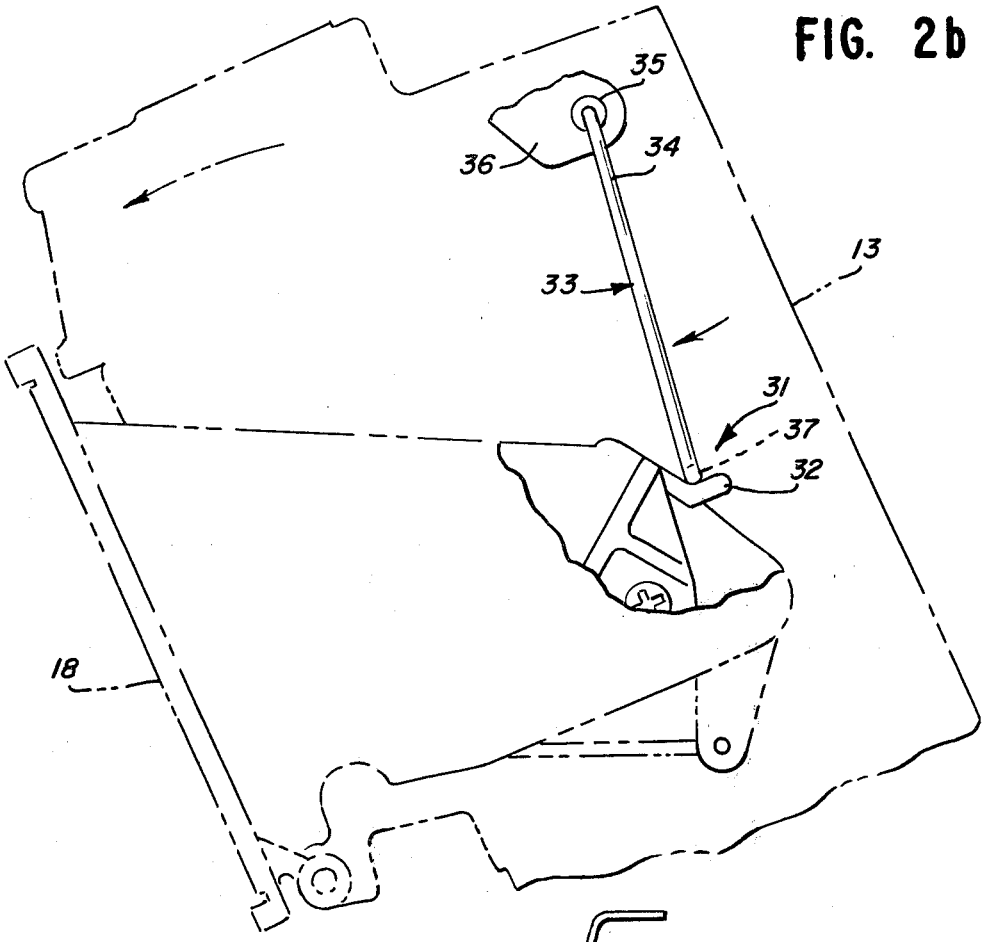
FIG. 2*b* is a view similar to that of FIG. 2*a* but illustrating the engagement of the latch element with means on the control console to prevent outward tilting of the control console when the main dishwasher door is swung downwardly from the closed position.

In the exemplary embodiment of the invention as disclosed in the drawing, particularly FIG. 1, a dishwasher generally designated 10 is illustratively shown to comprise a cabinet-mounted dishwasher installed in a conventional kitchen cabinet C. As will be obvious to those skilled in the art, the invention may be utilized in connection with any conventional dishwasher utilizing a cabinet 11 provided with a front vertical access opening 12 selectively closed by a door 13 hingedly mounted at a lower portion 14 thereof to the cabinet. Thus, the door 13 is selectively disposed in a vertical closed position, as seen in FIG. 1, closing the access opening 12, and in a downwardly pivoted generally horizontal position wherein the access opening 12 is open for access by the user of the dishwasher.

A tilt-out control console 16 is mounted in a control panel assembly 17 of the door and includes an outer door 18 attached to the control console for providing selective access to a program input switch control portion 16*a* for selective operation of the control in establishing the desired dishwashing operations. Door 13 is provided below the control panel assembly 17 with a handrail 15 for use in swinging the door between the closed and open positions.

Figure 3:
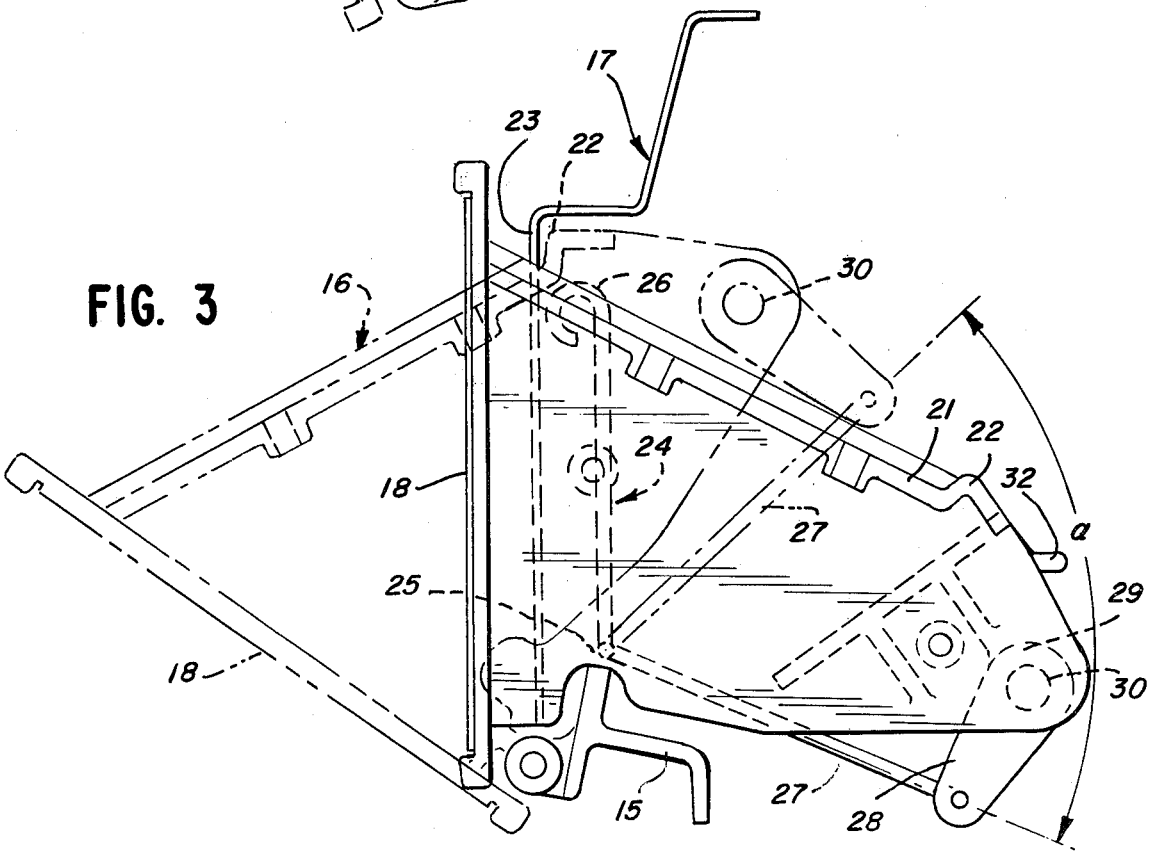
FIG. 3 is a fragmentary enlarged vertical section illustrating in greater detail the operation of the torsion spring means in providing the controlled light biasing of the control console toward the retracted disposition.

As seen in FIG. 2*a*, the handrail includes a handrail hinge assembly generally designated 19 on which the control console 16 including door 18 is pivotally mounted to swing from a closed position having the door 18 extending vertically across the control panel assembly 17, as seen in full lines in FIGS. 1 and 3, to an open position wherein the door is swung forwardly from the control panel 17, as shown in broken lines in FIG. 3, to expose the program input switch control portion 16*a* for manipulation by the user. The program input switches provide the user with a means for selecting various dishwashing cycles and options such as normal wash, short wash, rinse only etc., and a start switch for initiating the dishwashing operation.

As shown in FIG. 3, the control console 16 includes the front door panel 18 and a rearwardly extending wall portion 21 having a stop portion 22 at the rear end thereof which engages a downturned flange 23 on the control panel assembly 17 when the console 16 is swung to the open position shown in broken lines in FIG. 3.

The control console 16 is biased to the closed position shown in full lines in FIG. 3 by a torsion spring 24 which is held and mounted on the top edge 25 of the handrail hinge assembly to pivot about that position. One end 26 of the torsion spring engages the control panel flange 23, and the other end 27 is connected to a link 28 pivotally mounted at 30 to a sidewall 29 of the door assembly.

Torsion spring end 26 is biased in a vertical disposition while end 27 swings about the handrail assembly portion 25 when the tilt-out console is moved from the closed position to the open broken line position as illustrated in FIG. 3. As further shown therein, link 28 pivots on its pivotal mounting 30 to the sidewall 29 so that the total angular movement of the torsion spring end 27 is less than the angular movement of the door 18 in moving from the closed to the open position shown in FIG. 3. In the illustrated embodiment, the door panel 18 swings approximately 80° between the closed and open positions and the spring end 27 swings approximately 58°. Resultingly, the spring force applied by the torsion spring 24 is effectively minimized, permitting the user to swing the door panel 18 to the open position and operate the control console elements with effectively minimum effort. However, upon release of the door panel 18 by the user upon completion of the user's use of the control console, the door panel 18 automatically swings back to the closed position for effectively maintaining the control console in the closed disposition at all times other than when being used by the operator of the dishwasher.

Because of the relatively light spring force employed in biasing the control console to the closed disposition, it has been found desirable to provide means for automatically latching the console in the closed disposition when the access door 13 is swung downwardly from the vertical closed position of FIG. 1 to a horizontal access position for gaining entry to the interior of the dishwasher. As best seen in FIGS. 2*a* and 2*b*, stop means 31 are provided responsive to swinging of the access door 13 beyond a preselected small angle from the closed position illustrated in FIG. 1 for preventing pivoting of the tilt-out console by gravity from its closed position against the biasing action of the torsion spring 24, and preventing the user from swinging the tilt-out console 16 to its open position when the access door 13 is so swung, while permitting free pivoting of the tilt-out console by the user to its open position against the biasing action of the torsion spring when the access door is less than the preselected angle from the closed position thereof.

More specifically, as seen in FIGS. 2*a* and 2*b*, the stop means 31 includes a stop shoulder 32 in the form of a tongue on a rear portion 16*b* of the control console 16 and a latch element 33 movably carried by the access door 13 within the control panel assembly 17 for engagement with the stop shoulder 32 as a result of the swinging of the access door a small preselected angle in a counterclockwise direction from the vertical disposition of the closed access door, as shown in FIGS. 2*a* and 2*b*.

In the illustrated embodiment, as shown in FIG. 4, the latch element 33 comprises a U-shaped formed wire element having its legs 34 pivotally connected by means of pivots 35 to bracket 36 carried by the access door 13. The formed wire latch element further defines a bight portion 37 which is swung into the path of movement of the stop shoulder tongue 32 as the access door is swung from the vertical position of FIG. 2*a* to the inclined position of FIG. 2*b* so as to effectively positively preclude outward swinging of the tilt-out door, notwithstanding the downward swinging of the access door 13.

Thus, the biasing force developed by the biasing spring 24 may be relatively small so as to facilitate the user swinging the tilt-out console door 18 to the open position when it is desired to operate the program input switches of the control panel assembly. As the biasing force, therefore, may be insufficient to hold the tilt-out console in the closed position when the access door 13 is swung downwardly from the vertical disposition, the stop means 31 effectively positively prevents such undesirable downward movement of the tilt-out console at that time. However, stop means 31 is arranged to be disengaged in the normal swinging of the tilt-out console 16 to the open position by the user when desired.

As a result of the separation of the latch from the stop tongue 32, the inward biasing force is limited to the relatively light biasing force of the torsion spring, as discussed above.

Thus, the dishwasher structure 10 discussed above is extremely simple and economical of construction while yet providing an improved selective control of the tilt-out console for use with the electric control of the dishwasher.

The foregoing disclosure of specific embodiments is illustrative of the broad inventive concepts comprehended by the invention.

We claim:

1. In a dishwasher having a cabinet defining a vertical access opening, an access door having a control panel assembly for mounting a console and a lower portion hingedly mounted to the cabinet at the bottom of said opening to be swung selectively about a pivot axis of the hinged mounting between a vertical, closed position wherein the door closes said access opening to an outwardly tilted, open position wherein the access opening is open, a control console for operation by the user of the dishwasher for controlling dishwashing operation thereof, a tilt-out door for selectively covering the control console, means for pivotally mounting said tilt-out door to said control panel assembly of said access door, and biasing means for lightly biasing said tilt-out door to a closed position covering said control console and permitting the user to swing the tilt-out door outwardly from said closed position to an open position exposing the control console for access by the user, the improvement comprising stop means associated with said access door and said tilt-out door responsive to swinging of said access door beyond a small preselected angle from said closed position for preventing pivoting of said tilt-out door by gravity substantially from its closed position against the biasing action of said biasing means and preventing the user from swinging the tilt-out door to its open position when the access door is so swung beyond said preselected angle while permitting free pivoting of the tilt-out door by the user to its open position against said biasing action when the access door is less than said preselected angle from said closed position thereof.

2. In a dishwasher having a cabinet defining a vertical access opening, an access door having a control panel assembly for mounting a console and a lower portion hingedly mounted to the cabinet at the bottom of said opening to be swung selectively about a pivot axis of the hinged mounting between a vertical, closed position wherein the door closes said access opening to an outwardly tilted, open position wherein the access opening is open, a control console for operation by the user of the dishwasher for controlling dishwashing operation thereof, a tilt-out door for selectively covering the control console, means for pivotally mounting said tilt-out door to said control panel assembly of said access door, and biasing means for lightly biasing said tilt-out door to a closed position covering said control console and permitting the user to swing the tilt-out door outwardly from said closed position to an open position exposing the control console for access by the user, the improvement comprising stop means responsive to swinging of said access door beyond a small preselected angle from said closed position for preventing pivoting of said tilt-out door by gravity from its closed position against the biasing action of said biasing means and preventing the user from swinging the tilt-out door to its open position when the access door is so swung while permitting free pivoting of the tilt-out door by the user to its open position against said biasing action when the access door is less than said preselected angle from said closed position thereof, said console being connected to said tilt-out door for movement therewith and said stop means including a stop shoulder fixed to said console and a latch movably carried by said access door for engagement with said stop shoulder as a result of said swinging of the access door beyond said preselected angle.

3. In a dishwasher having a cabinet defining a vertical access opening, an access door having a control panel assembly for mounting a console and a lower portion hingedly mounted to the cabinet at the bottom of said opening to be swung selectively about a pivot axis of the hinged mounting between a vertical, closed position wherein the door closes said access opening to an outwardly tilted, open position wherein the access opening is open, a control console for operation by the user of the dishwasher for controlling dishwashing operation thereof, a tilt-out door for selectively covering the control console, means for pivotally mounting said tilt-out door to said control panel assembly of said access door, and biasing means for lightly biasing said tilt-out door to a closed position covering said control console and permitting the user to swing the tilt-out door outwardly from said closed position to an open position exposing the control console for access by the user, the improvement comprising stop means responsive to swinging of said access door beyond a small preselected angle from said closed position for preventing pivoting of said tilt-out door by gravity from its closed position against the biasing action of said biasing means and preventing the user from swinging the tilt-out door to its open position when the access door is so swung while permitting free pivoting of the tilt-out door by the user to its open position against said biasing action when the access door is less than said preselected angle from said closed position thereof, said stop means including a stop shoulder fixed to said tilt-out door and a formed wire latch movably carried by said access door for engagement with said stop shoulder as a result of said swinging of the access door beyond said preselected angle.

4. In a dishwasher having a cabinet defining a vertical access opening, an access door having a control panel assembly for mounting a console and a lower portion hingedly mounted to the cabinet at the bottom of said opening to be swung selectively about a pivot axis of the hinged mounting between a vertical, closed position wherein the door closes said access opening to an outwardly tilted, open position wherein the access opening is open, a control console for operation by the user of the dishwasher for controlling dishwashing operation thereof, a tilt-out door for selectively covering the control console, means for pivotally mounting said tilt-out door to said control panel assembly of said access door, and biasing means for lightly biasing said tilt-out door to a closed position covering said control console and permitting the user to swing the tilt-out door outwardly from said closed position to an open position exposing the control console for access by the user, the improvement comprising stop means responsive to swinging of said access door beyond a small preselected angle from said closed position for preventing pivoting of said tilt-out door by gravity from its closed position against the biasing action of said biasing means and preventing the user from swinging the tilt-out door to its open position when the access door is so swung while permitting free pivoting of the tilt-out door by the user to its open position against said biasing action when the access door is less than said preselected angle from said closed position thereof, said stop means including a projecting tongue fixed to said tilt-out door and a latch movably carried by said access door for engagement with said projecting tongue as a result of said swinging of the access door beyond said preselected angle.

5. The dishwasher structure of claim 1 wherein said biasing means comprises a torsion spring and means for winding said torsion spring as a result of pivotal movement of said tilt-out door, said means for winding the torsion spring being arranged to wind the spring an angular amount less than the angular amount of pivoting of the tilt-out door to effectively minimize the biasing force applied by said biasing means to said tilt-out door in said open position thereof.

6. In a dishwasher having a cabinet defining a vertical access opening, an access door having a control panel assembly for mounting a console and a lower portion hingedly mounted to the cabinet at the bottom of said opening to be swung selectively about a pivot axis of the hinged mounting between a vertical, closed position wherein the door closes said access opening to an outwardly tilted, open position wherein the access opening is open, a control console for operation by the user of the dishwasher for controlling dishwashing operation thereof, a tilt-out door for selectively covering the control console, means for pivotally mounting said tilt-out door to said control panel assembly of said access door, and biasing means for lightly biasing said tilt-out door to a closed position covering said control console and permitting the user to swing the tilt-out door outwardly from said closed position to an open position exposing the control console for access by the user, the improvement comprising stop means responsive to swinging of said access door beyond a small preselected angle from said closed position for preventing pivoting of said tilt-out door by gravity from its closed position against the biasing action of said biasing means and preventing the user from swinging the tilt-out door to its open position when the access door is so swung while permitting free pivoting of the tilt-out door by the user to its open position against said biasing action when the access door is less than said preselected angle from said closed position thereof, said console being integral with said door and said stop means including a stop shoulder fixed to said console and a latch movably carried by said access door to be disposed rearwardly of said control console when the access door is disposed in said closed position and movable into engagement with said stop shoulder as a result of said swinging of the access door beyond said preselected angle.

7. In a dishwasher having a cabinet defining a vertical access opening, an access door having a control panel assembly for mounting a console and a lower portion hingedly mounted to the cabinet at the bottom of said opening to be swung selectively about a pivot axis of the hinged mounting between a vertical, closed position wherein the door closes said access opening to an outwardly tilted, open position wherein the access opening is open, a control console for operation by the user of the dishwasher for controlling dishwashing operation thereof, a tilt-out door for selectively covering the control console, means for pivotally mounting said tilt-out door to said control panel assembly of said access door, and biasing means for lightly biasing said tilt-out door to a closed position covering said control console and permitting the user to swing the tilt-out door outwardly from said closed position to an open position exposing the control console for access by the user, the improvement comprising stop means responsive to swinging of said access door beyond a small preselected angle from said closed position for preventing pivoting of said tilt-out door by gravity from its closed position against the biasing action of said biasing means and preventing the user from swinging the tilt-out door to its open position when the access door is so swung while permitting free pivoting of the tilt-out door by the user to its open position against said biasing action when the access door is less than said preselected angle from said closed position thereof, said stop means including a stop shoulder fixed to said tilt-out door and a U-shaped latch element having legs pivotally mounted to said access door and a bight disposed for engagement with said stop shoulder as a result of said swinging of the access door beyond said preselected angle.

8. In a dishwasher having a cabinet defining a vertical access opening, an access door having a control panel assembly for mounting a console and a lower portion hingedly mounted to the cabinet at the bottom of said opening to be swung selectively about the pivot axis of the hinged mounting between a vertical, closed position wherein the door closes said access opening to an outwardly tilted, open position wherein the access opening is open, a tilt-out control console for operation by the user of the dishwasher for controlling dishwashing operation thereof, said console including an attached door for selectively covering at least a portion of the panel assembly, means for pivotally mounting said console to said panel assembly of said access door, and biasing means for lightly biasing said control console to a closed position within said panel assembly with said door covering said control console and permitting the user to swing the console outwardly from said closed position to an open position exposing input switches on the control console for access by the user, the improvement comprising stop means associated with said access door and said tilt-out door responsive to swinging of said access door beyond a small preselected angle from said closed position for preventing pivoting of said console by gravity substantially from its closed position against the biasing action of said biasing means and preventing the user from swinging the console to its open position when the access door is so swung beyond said preselected angle while permitting free pivoting of the console by the user to its open position against said biasing action when the access door is less than said preselected angle from said closed position thereof.

9. In a dishwasher having a cabinet defining a vertical access opening, an access door having a control panel assembly for mounting a console and a lower portion hingedly mounted to the cabinet at the bottom of said opening to be swung selectively about the pivot axis of the hinged mounting between a vertical, closed position wherein the door closes said access opening to an outwardly tilted, open position wherein the access opening is open, a tilt-out control console for operation by the user of the dishwasher for controlling dishwashing operation thereof, said console including an attached door for selectively covering at least a portion of the panel assembly, means for pivotally mounting said console to said panel assembly of said access door, and biasing means for lightly biasing said control console to a closed position within said panel assembly with said door covering said control console and permitting the user to swing the console outwardly from said closed position to an open position exposing input switches on the control console for access by the user, the improvement comprising stop means responsive to swinging of said access door beyond a small preselected angle from said closed position for preventing pivoting of said console by gravity from its closed position against the biasing action of said biasing means and preventing the user from swinging the console to its open position when the access door is so swung while permitting free pivoting of the console by the user to its open position against said biasing action when the access door is less than said preselected angle from said closed position thereof, said stop means including a projecting tongue fixed to said console and a U-shaped formed wire latch element having legs pivotally mounted to said access door and a bight disposed for engagement with said projecting tongue as a result of said swinging of the access door beyond said preselected angle.

10. In a dishwasher having a cabinet defining a vertical access opening, an access door having a control panel assembly for mounting a console and a lower portion hingedly mounted to the cabinet at the bottom of said opening to be swung selectively about the pivot axis of the hinged mounting between a vertical, closed position wherein the door closes said access opening to an outwardly tilted, open position wherein the access opening is open, a tilt-out control console for operation by the user of the dishwasher for controlling dishwashing operation thereof, said console including an attached door for selectively covering at least a portion of the panel assembly, means for pivotally mounting said console to said panel assembly of said access door, and biasing means for lightly biasing said control console to a closed position within said panel assembly with said door covering said control console and permitting the user to swing the console outwardly from said closed position to an open position exposing input switches on the control console for access by the user, the improvement comprising stop means responsive to swinging of said access door beyond a small preselected angle from said closed position for preventing pivoting of said console by gravity from its closed position against the biasing action of said biasing means and preventing the user from swinging the console to its open position when the access door is so swung while permitting free pivoting of the console by the user to its open position against said biasing action when the access door is less than said preselected angle from said closed position thereof, said stop means including a projecting tongue fixed to said console and a U-shaped formed wire latch element having legs pivotally mounted to said access door and a bight disposed rearwardly of said control console when the access door is disposed in said closed position and movable into engagement with said projecting tongue as a result of said swinging of the access door beyond said preselected angle.

* * * * *